US008454014B2

(12) United States Patent
Kotera

(10) Patent No.: US 8,454,014 B2
(45) Date of Patent: Jun. 4, 2013

(54) IMAGE FORMING APPARATUS AND JUNCTION UNIT

(75) Inventor: Shinichi Kotera, Osaka (JP)

(73) Assignee: Kyocera Mita Corporation (JP)

( * ) Notice: Subject to any disclaimer, the term of this patent is extended or adjusted under 35 U.S.C. 154(b) by 9 days.

(21) Appl. No.: 13/043,995

(22) Filed: Mar. 9, 2011

(65) Prior Publication Data

US 2011/0227272 A1 Sep. 22, 2011

(30) Foreign Application Priority Data

Mar. 19, 2010 (JP) ..... 2010-064327

(51) Int. Cl.
*B65H 5/06* (2006.01)

(52) U.S. Cl.
USPC ..... 271/273; 271/272; 271/3.14

(58) Field of Classification Search
USPC ..... 271/272, 273, 264, 3.14
See application file for complete search history.

(56) References Cited

U.S. PATENT DOCUMENTS 6,145,828 A * 11/2000 Arai ..... 271/3.03
7,168,701 B2 * 1/2007 Isaka et al. ..... 271/273
7,548,723 B2 * 6/2009 Kang ..... 399/405
7,950,659 B2 * 5/2011 Matsushima ..... 271/264
8,083,230 B2 * 12/2011 Spence ..... 271/273
8,083,231 B2 * 12/2011 Hirata et al. ..... 271/273
2005/0067773 A1 * 3/2005 Yoshida et al. ..... 271/264
2006/0103068 A1 * 5/2006 Sekiya ..... 271/264

FOREIGN PATENT DOCUMENTS

JP 940203 2/1997
JP 2000-327170 11/2000
JP 2008304551 12/2008

* cited by examiner

*Primary Examiner* — Kaitlin Joerger
(74) *Attorney, Agent, or Firm* — Gerald E. Hespos; Michael J. Porco; Matthew T. Hespos

(57) ABSTRACT

An image forming apparatus has a main body for performing an image forming process on a sheet. An internal discharge stores a sheet after the image forming process and a discharge opening discharges a sheet to the internal discharge. A post-processing unit can be attached to the apparatus main body to apply a specified post processing to a received sheet. A junction can be assembled into the internal discharge to convey a sheet from the discharge opening to a receiving opening of the post-processing unit. The junction includes a first guide having a first guide surface for guiding a sheet, a second guide having a second guide surface facing the first guide at a predetermined distance and a support for supporting the second guide by a rotatable supporting portion. The support has a facing surface facing the first guide surface and has the supporting portion arranged on the facing surface.

13 Claims, 12 Drawing Sheets

IMAGE FORMING APPARATUS AND JUNCTION UNIT

BACKGROUND OF THE INVENTION

1. Field of the Invention

The present invention relates to a junction unit to be assembled later into an internal sheet discharge space to convey a sheet toward a post-processing unit and an image forming apparatus provided with such a junction unit.

2. Description of the Background Art

An image forming apparatus of a so-called internal discharge type including a space, into which a sheet after image formation is to be discharged, in an apparatus main body has advantages of smaller space occupancy and good storage property since a sheet tray or the like does not project from the apparatus main body. On the other hand, a post-processing unit for applying post processings such as punching and stapling may be optionally attached later to such an image forming apparatus of the internal discharge type. Generally, a discharge opening for sheets is facing an internal discharge space, and the internal discharge space is small and it is difficult to install the post-processing unit in this space.

In a conventional apparatus, in the case of attaching a post-processing unit later, the post-processing unit is installed on a side wall portion of an apparatus main body (side wall opposite to the one where a sheet discharge opening is provided) and a junction unit including a sheet conveying function is assembled in the internal discharge space. A sheet is conveyed from the discharge opening to the post-processing unit via this junction unit. Note that the junction unit is fixed to the apparatus main body by screws or the like, and a user cannot easily detach the once assembled junction unit from the internal discharge space.

Also in the junction unit, a sheet jam may occur similar to other sheet conveyance paths. As an anti-jam measure, it is necessary to make a sheet conveyance path of the junction unit openable. In a conventional apparatus, a cover having an upper guide surface is rotatably mounted on a base having a lower guide surface. A rotary shaft is provided at the back side of the cover, and the rotary shaft is rotatably supported on a vertical wall standing on the base at the back side.

However, the construction of the conventional apparatus has a disadvantage that the size of the junction unit including a rotation supporting portion is large. Except when the internal discharge space is relatively large, the construction of the conventional apparatus is unsuitable for a small image forming apparatus having a relatively small internal discharge space, and a junction unit which can be miniaturized is required.

SUMMARY OF THE INVENTION

An object of the present invention is to miniaturize a junction unit which is assembled later into an internal discharge space of an image forming apparatus and openable and closable as an anti-jam measure.

In order to accomplish this object, one aspect of the present invention is directed to an image forming apparatus, including an apparatus main body for performing an image forming process on a sheet; an internal discharge portion formed in the apparatus main body as an internal space with an opening exposed to the outside and capable of storing a sheet after the image forming process; a discharge opening provided in the apparatus main body to face the internal space and adapted to discharge a sheet to the internal discharge portion; a post-processing unit attachable later to the apparatus main body, including a receiving opening for sheets and adapted to apply a specified post processing to a received sheet; and a junction unit to be assembled into the internal discharge portion and adapted to convey a sheet from the discharge opening to the receiving opening; wherein the junction unit includes a first guide member having a first guide surface for guiding a sheet, a second guide member having a second guide surface facing the first guide member at a predetermined distance therefrom and a supporting member for supporting the second guide member by a rotatable supporting portion; and the supporting member has a facing surface facing the first guide surface and has the supporting portion arranged on the facing surface.

Another aspect of the present invention is directed to a junction unit, including a first opening for receiving a sheet; a second opening for sending the sheet out; a lower guide member forming a lower guide surface of a conveyance path for conveying the sheet from the first opening and the second opening substantially in a horizontal direction; an upper guide member forming an upper guide surface of the conveyance path and rotatably mounted on the lower guide member; and a supporting member for supporting the upper guide member by a rotatable supporting portion; wherein the supporting member has a facing surface facing the lower guide surface and the supporting portion is arranged on the facing surface.

These and other objects, features and advantages of the present invention will become more apparent upon reading the following detailed description along with the accompanying drawings.

DETAILED DESCRIPTION OF THE PREFERRED EMBODIMENTS

Figure 1:
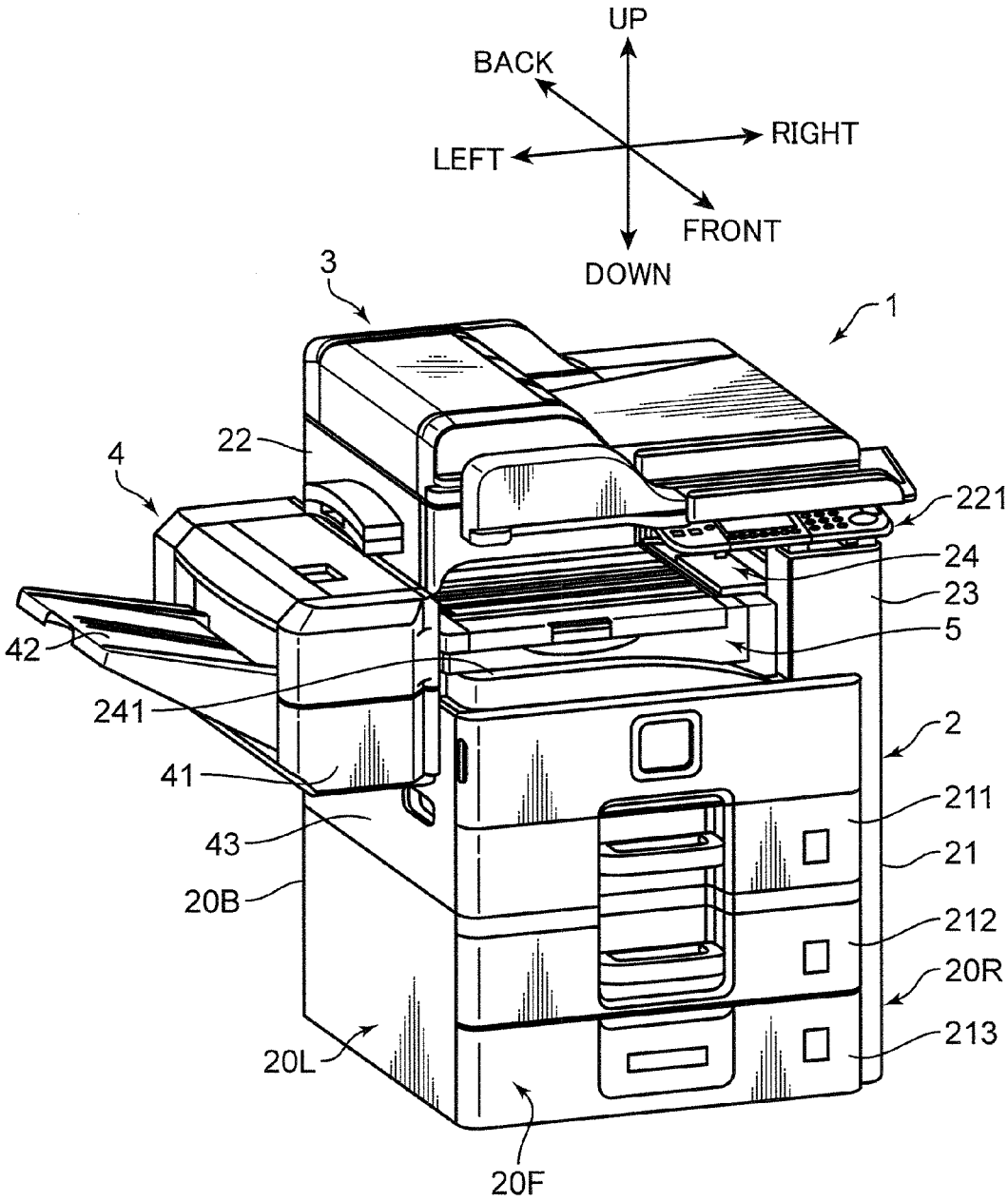
FIG. 1 is a perspective view showing an external appearance of an image forming apparatus according to one embodiment of the invention.
Figure 2:
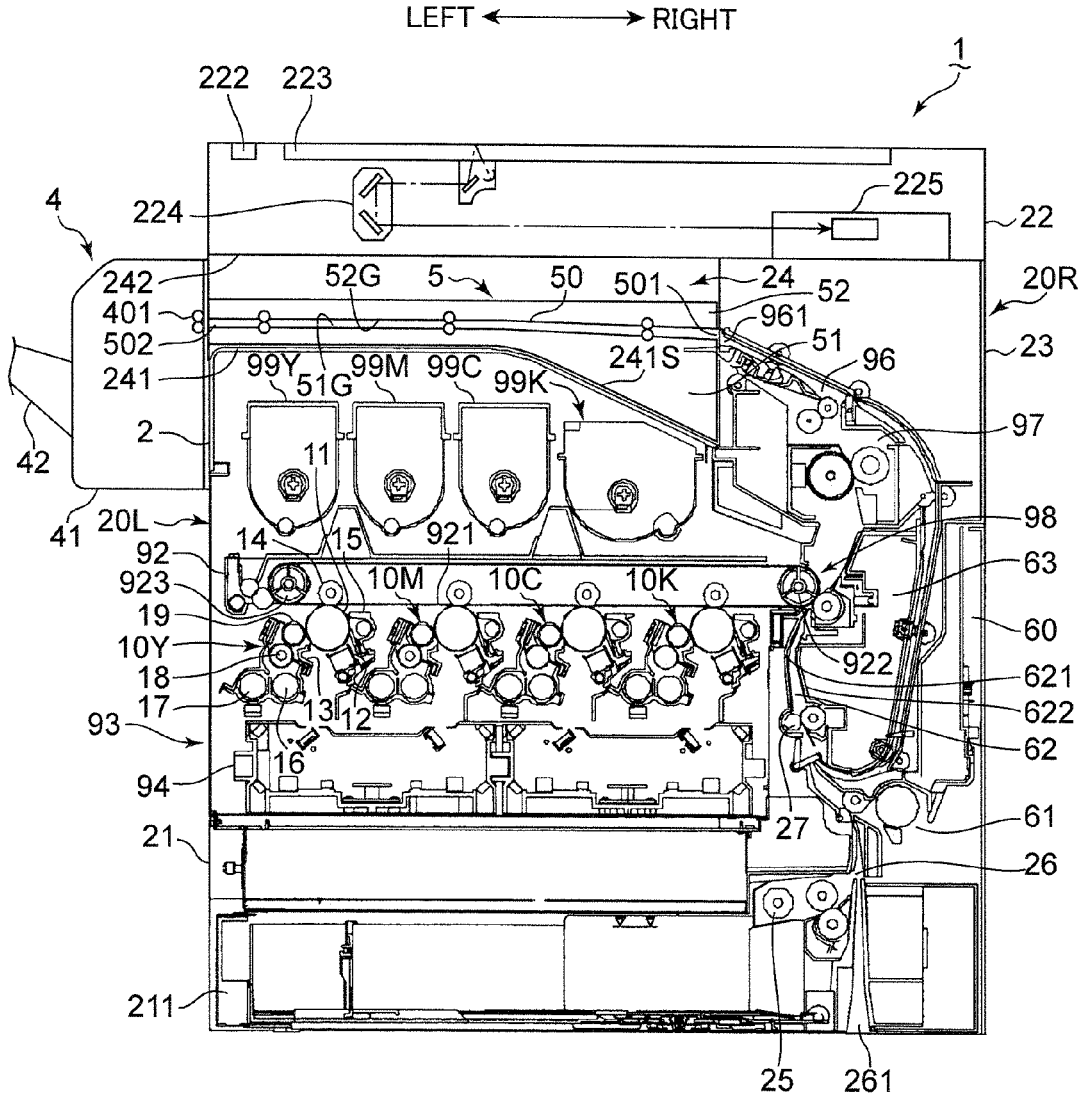
FIG. 2 is a sectional view showing an internal structure of the image forming apparatus.

Hereinafter, one embodiment of the present invention is described in detail with reference to the drawings. FIG. 1 is a perspective view showing an external appearance of an image forming apparatus 1 according to one embodiment of the invention, and FIG. 2 is a sectional view showing an internal structure of the image forming apparatus 1. Here, the image forming apparatus 1 is a copier of a so-called internal discharge type, but the image forming apparatus may be a printer, a facsimile machine, or a complex machine provided with these functions as long as it internally discharges sheets.

The image forming apparatus 1 includes an apparatus main body 2 having a substantially rectangular parallelepipedic housing structure and an internal space (internal discharge space 24), an automatic document feeder 3 arranged on the apparatus main body 2, a post-processing unit 4 arranged on a side surface of the apparatus main body 2 and a junction unit 5 to be installed in the internal space. The apparatus main body 2 performs an image forming process on a sheet. The automatic document feeder 3 is attached to the apparatus main body 2 to provide a function of automatically reading documents. The post-processing unit 4 applies specified post-processings to sheet(s) after image formation. The junction unit 5 conveys a sheet after image formation from the apparatus main body 2 to the post-processing unit 4.

The apparatus main body 2 includes a substantially rectangular parallelepipedic lower housing 21, a substantially rectangular parallelepipedic upper housing arranged above the lower housing 21, and a coupling housing 23 coupling the lower housing 21 and the upper housing 22. Various devices for image formation are housed in the lower housing 21, and various devices for optically reading a document image are housed in the upper housing 22. An internal space enclosed by the lower housing 21, the upper housing 22 and the coupling housing 23 serves as an internal discharge portion 24 capable of storing a sheet after image formation. The coupling housing 23 is arranged at a side of a right surface 20R of the apparatus main body 2 and provided with a discharge opening 961 for discharging a sheet to the internal discharge portion 24.

The internal space utilized as the internal discharge portion 24 is exposed to the outside at a front surface 20F and a left surface 20L of the apparatus main body 2. A user can take a sheet after image formation out from the internal discharge portion 24 by inserting his or her hand through these exposed parts in a state where the post-processing unit 4 and the junction unit 5 are not attached to the apparatus main body 2. A bottom surface 241 of the internal space is defined by the upper surface of the lower housing 21, and a ceiling surface 242 thereof is defined by the lower surface of the upper housing 22. The bottom surface 241 includes an inclined surface 241S inclined downward toward the coupling housing 23 to align discharged sheets at their rear ends in a conveying direction.

An operation unit 221 is provided to project from the front surface of the upper housing 22. The operation unit 221 includes an LCD touch panel, a numerical pad, a start key, etc. and receives input of various operation instructions from the user. The user can input the number of sheets to be printed, print density, etc. by means of the operation unit 221.

Sheet cassettes 211, 212 and 213 storing sheets, to which an image forming process is to be applied, are mounted in three levels in the lower housing 21. These sheet cassettes 211, 212 and 213 can be withdrawn forward from the front surface 20F of the lower housing 21 (apparatus main body 2). Only the uppermost sheet cassette 221 is shown in FIG. 2. The sheet cassettes 211, 212 and 213 are those for automatic feeding, whereas a feed tray 60 for manual feeding is provided on the right surface 20R of the apparatus main body 2 (see FIG. 2). The feed tray 60 is so mounted at its lower end as to be openable and closable with respect to the lower housing 21. The user opens the feed tray 60 and places a sheet thereon in the case of manually feeding the sheet.

The automatic document feeder 3 is rotatably mounted on the upper surface of the apparatus main body 2 at a side of a rear surface 20B. This automatic document feeder 3 is not shown in FIG. 2. The automatic document feeder 3 automatically feeds a document sheet to be copied toward a predetermined document reading position (position where a first contact glass 222 is assembled) in the apparatus main body 2. On the other hand, the automatic document feeder 2 is opened upward when the user manually places a document sheet on a predetermined document reading position (arrangement position of a second contact glass 223).

The post-processing unit 4 is an optional unit to be added later to the apparatus main body 2, and discharges sheets having image after applying a post processing such as punching or stapling to the sheets. The post-processing unit 4 is mounted at a position of the left side surface 20L of the apparatus main body 2 facing the left exposed part of the internal discharge portion 24 via a mounting plate 43. The post-processing unit 4 includes a sheet receiving opening 401 (FIG. 2) facing the internal discharge portion 24 to receive a sheet, a main unit 41 having a mechanical unit for post processing built therein, and a discharge tray 42 from which sheets after post processing are discharged. Sheets having the post processing applied thereto in the main unit 41 are, of course, discharged to the discharge tray 42, and sheets which are merely passed through the main unit 41 without any post processing applied thereto are also discharged to the discharge tray 42.

Next, an internal structure of the apparatus main body 2 is described. Toner containers 99Y, 99M, 99C and 99K, an intermediate transfer unit 92, an image forming station 93, an exposure unit 94 and the above sheet cassette 211 are housed in this order from top in the lower housing 21.

The image forming station 93 includes four image forming units 10Y, 10M, 10C and 10K for forming toner images of yellow (Y), magenta (M), cyan (C) and black (K) to form a full-color toner image. Each of the image forming units 10Y, 10M, 10C and 10K includes a photoconductive drum 11, and a charger 12, a developing device 13, a primary transfer roller 14 and a cleaner 15 arranged around the photoconductive drum 11.

The photoconductive drum 11 rotates about its shaft and has an electrostatic latent image and a toner image formed on its circumference surface. A photoconductive drum using an amorphous silicon (a-Si) containing material can be used as the photoconductive drum 11. The charger 12 uniformly charges the circumferential surface of the photoconductive drum 11. The circumferential surface of the photoconductive drum 11 after charging is exposed by the exposure unit 94 to form an electrostatic latent image.

The developing device 13 supplies toner to the circumferential surface of the photoconductive drum 11 to develop the electrostatic latent image formed on the photoconductive drum 11. The developing device 13 is for a two-component developer and includes agitating rollers 16, 17, a magnetic roller 18 and a developing roller 19. The agitating rollers 16, 17 charge the toner by conveying the two-component developer in a circulating manner while agitating it. The two-component developer is carried on the circumferential surface of the magnetic roller 18, and the toner is transferred to the circumferential surface of the developing roller 19 due to a potential difference between the magnetic roller 18 and the developing roller 19, whereby a toner layer is formed on the circumferential surface of the developing roller 19. The toner on the developing roller 19 is supplied to the circumferential surface of the photoconductive drum 11, thereby developing the electrostatic latent image.

The primary transfer roller 14 forms a nip portion together with the photoconductive drum 11 for sandwiching an intermediate transfer belt 921 of the intermediate transfer unit 92, and primarily transfers the toner image on the photoconductive drum 11 to the intermediate transfer belt 921. The cleaner 15 cleans the circumferential surface of the photoconductive drum 11 after the transfer of the toner image.

The yellow toner container 99Y, the magenta toner container 99M, the cyan toner container 99C and the black toner container 99K are respectively for storing toners of the respective colors, and supply the toners of the respective colors to the developing device 13 of the image forming units 10Y, 10M, 10C and 10K of the corresponding YMCK colors via unillustrated supply paths.

The exposure unit 94 includes a light source and various optical components such as a polygon mirror, a reflecting mirror and a deflecting mirror, and irradiates the circumferential surfaces of the photoconductive drums 11 provided in the respective image forming units 10Y, 10M, 10C and 10K with beams based on image data of a document image to form electrostatic latent images.

The intermediate transfer unit 92 includes the intermediate transfer belt 921, a drive roller 922 and a driven roller 923. Toner images from a plurality of photoconductive drums 11 are superimposed on the intermediate transfer belt 921 (primary transfer). The superimposed toner images are secondarily transferred to a sheet supplied from the sheet cassette 211 or the feed tray 60 in a secondary transfer unit 98. The drive roller 922 and the driven roller 923 for rotating the intermediate transfer belt 921 are rotatably supported on the lower housing 21.

The sheet cassette 211 stores a bundle of sheets stacked one over another. A pickup roller 25 is arranged above the right end of the sheet cassette 211. By driving the pickup roller 25, the uppermost sheet of the sheet bundle in the sheet cassette 211 is pickup up one by one and conveyed to a carry-in conveyance path 26. A connecting conveyance path 261 extending from the bottom joins this carry-in conveyance path 26, and sheets picked up from the lower sheet cassettes 212, 213 (see FIG. 1) are conveyed to the carry-in conveyance path 26 via this connecting conveyance path 261. On the other hand, a sheet placed on the feed tray 60 is conveyed to the carry-in conveyance path 26 by driving a feed roller 61.

A sheet conveyance path 62 extending up to the discharge opening 961 via the secondary transfer unit 98, a fixing unit 97 and a discharge unit 96 to be described later is provided downstream of the carry-in conveyance path 26. An upstream part of the sheet conveyance path 62 is formed between an inner wall 621 formed on the lower housing 21 and an inner wall 622 forming the inner surface of a reversing unit 63. A pair of registration rollers 27 is arranged at a position of the sheet conveyance path 62 upstream of the secondary transfer unit 98. The sheet is temporarily stopped by the pair of registration rollers 27 and fed to the secondary transfer unit 98 at a predetermined timing for image transfer after a skew correction.

The fixing unit 97 and the discharge unit 96 are housed in the coupling housing 23. The fixing unit 97 includes a fixing roller and a pressure roller and performs a fixing process by heating and pressing a sheet having a toner image secondarily transferred in the secondary transfer unit 98. The sheet with the fixed color image is discharged from the discharge opening 961 toward the internal discharge portion 24 by the discharge unit 96 arranged downstream of the fixing unit 97.

The first contact glass 222 and the second contact glass 223 are fitted in the upper surface of the upper housing 22. The first contact glass 222 is for reading a document sheet automatically fed by the automatic document feeder 3 and the second contact glass 223 is for reading a manually placed document sheet. A scanning mechanism 224 and an image pickup device 225 for optically reading document information are housed in the upper housing 22. The scanning mechanism 224 includes a light source, a moving carriage, a reflecting mirror, etc. and introduces reflected light from a document to the image pickup device 225. The image pickup device 225 photoelectrically converts the reflected light into an analog electrical signal, which is input to the exposure unit 94 after being converted into a digital electrical signal in an A/D conversion circuit (not shown).

The junction unit 5 is assembled into the internal discharge portion 24 to convey a sheet in a horizontal direction from the discharge opening 961 for discharging the sheet from the apparatus main body 2 to the sheet receiving opening 401 of the post-processing unit 4 across the internal space (internal discharge portion 24) when the post-processing unit 4 is mounted on the left surface 20L of the apparatus main body 2 later. The junction unit 5 includes two guide members placed one over the other, i.e. a lower guide member 51 (first guide member) and an upper guide member 52 (second guide member) and a junction conveyance path 50 (sheet conveyance path) extending in the horizontal direction between these two guide members.

The lower guide member 51 has a lower guide surface 51G (first guide surface) for guiding a sheet being conveyed and the upper guide member 52 has a similar upper guide surface 52G (second guide surface). The junction conveyance path 50 is formed by arranging the lower and upper guide surfaces 51G, 52G to face each other at a predetermined distance. A carry-in opening 501 (first opening) for receiving a sheet from the discharge opening 961 is provided at the right end (upstream end) of the junction conveyance path 50, and a carry-out opening 502 (second opening) for feeding the sheet to the receiving opening 401 of the post-processing unit 4 is provided at the left end (downstream end) of the junction conveyance path 50.

Figure 3:
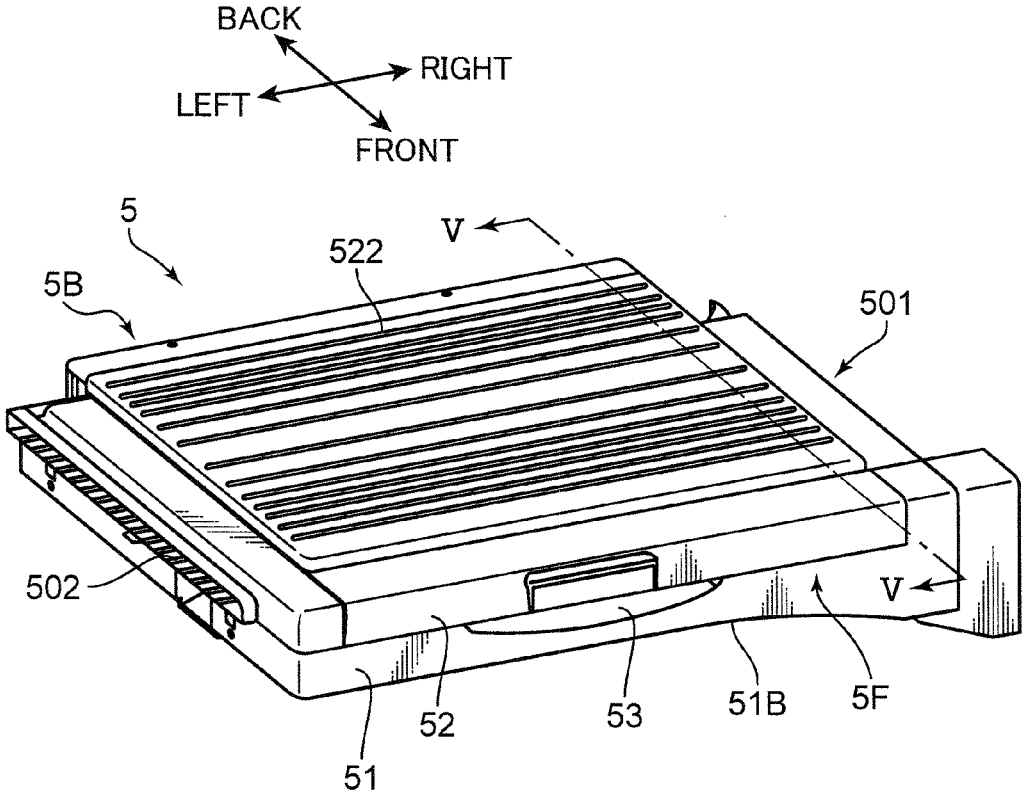
FIG. 3 is a perspective view of a junction unit in a state where an upper guide member is closed.
Figure 4:
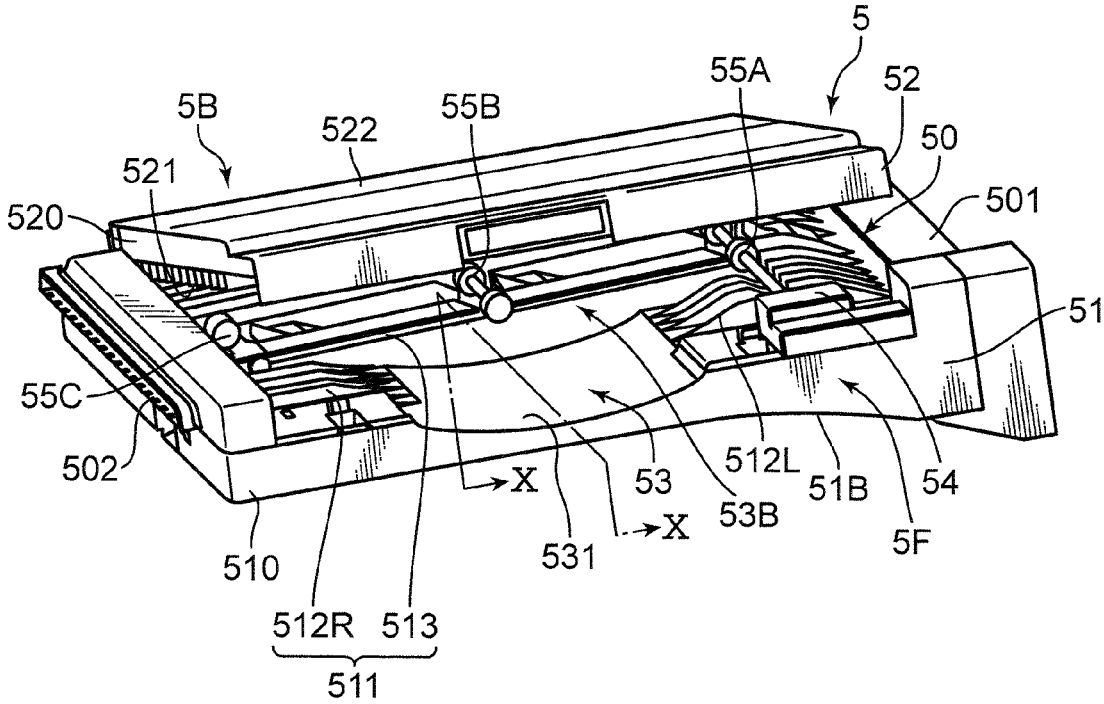
FIG. 4 is a perspective view of the junction unit in a state where the upper guide member is opened.
Figure 5:
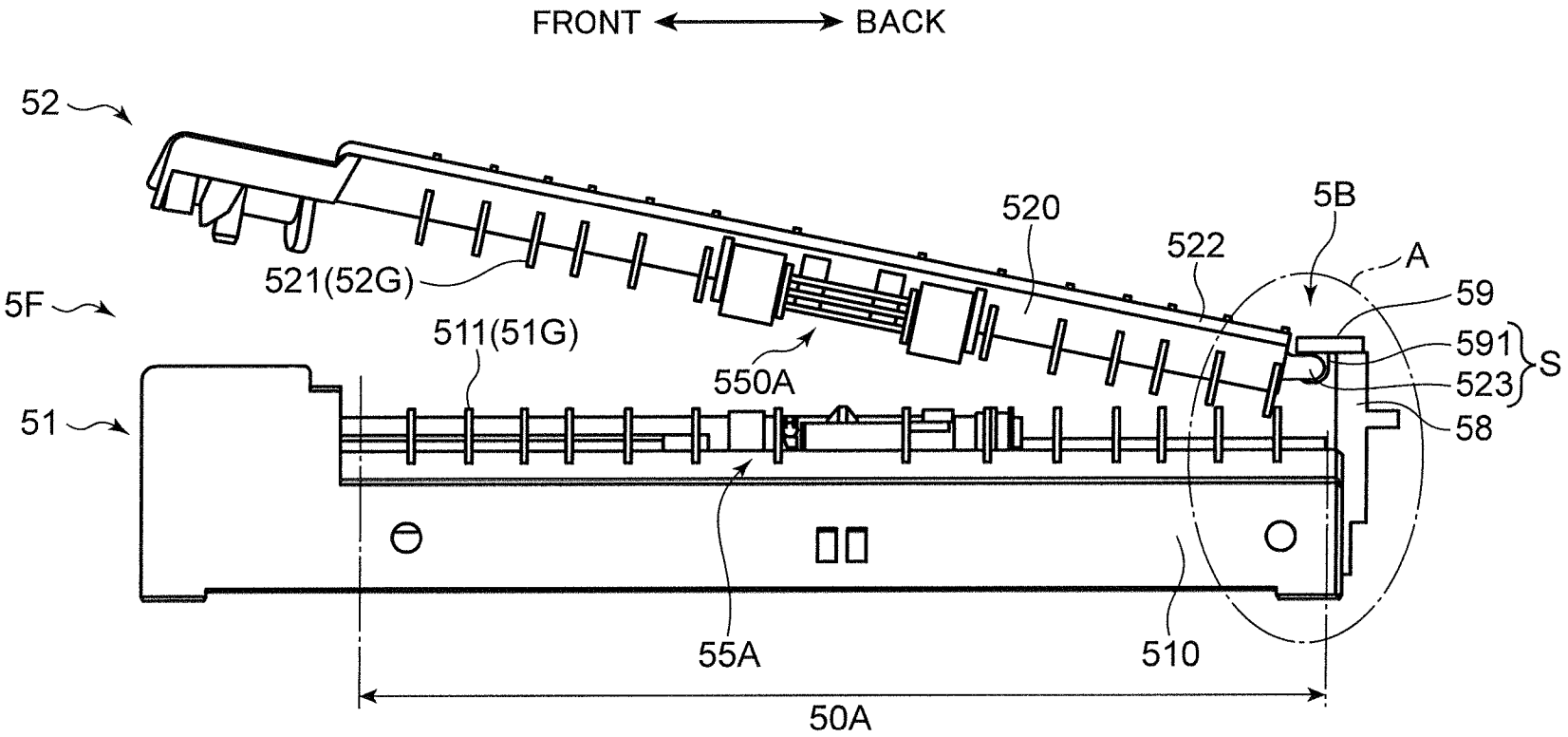
FIG. 5 is a sectional view along V-V of FIG. 3.
Figure 6:
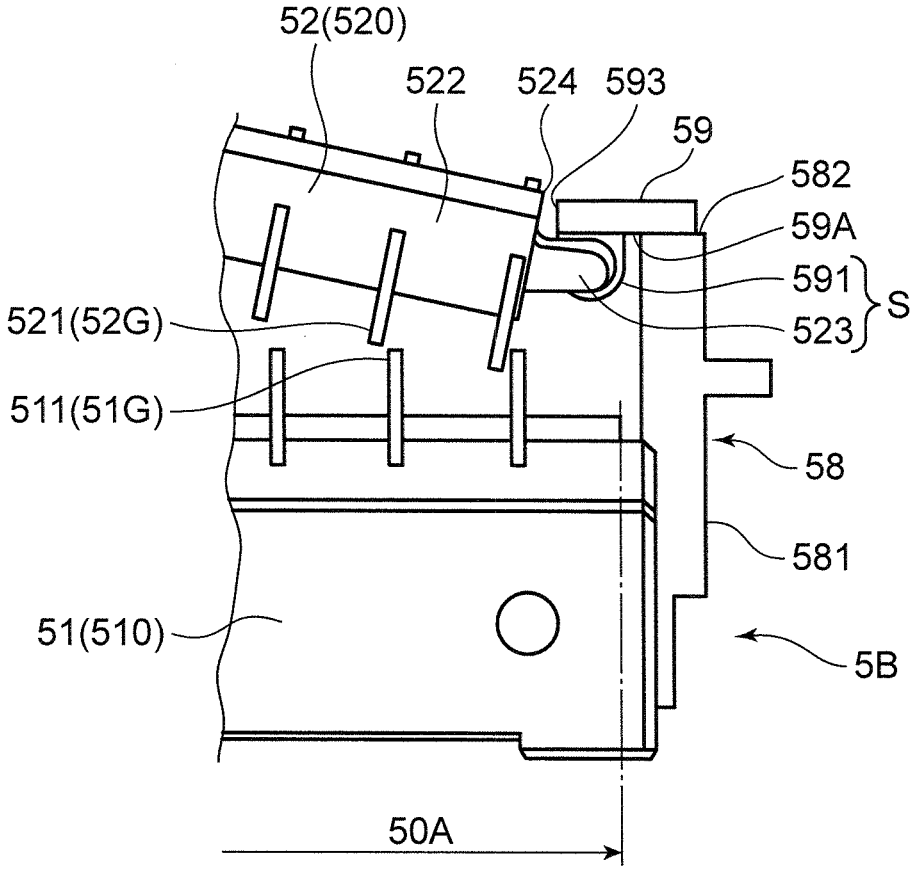
FIG. 6 is an enlarged view of a part A of FIG. 5.

FIGS. 3 and 4 are perspective views of the junction unit 5, wherein the FIG. 3 shows a closed state of the upper guide member 52 and FIG. 4 shows an opened state of the upper guide member 52. FIG. 5 is a sectional view along V-V of FIG. 3, and FIG. 6 is an enlarged view of a part A of FIG. 5.

Widths of the junction unit 5 in a lateral direction and forward and backward directions are substantially equal to those of the internal discharge portion 24. A bottom surface 51B of the lower guide member 51 includes an inclined part in conformity with an inclined shape of the inclined portion 241S of the internal discharge portion 24. This junction unit 5 is fixed to the apparatus main body 2 by unillustrated screws after being assembled into the internal discharge portion 24. Accordingly, after the post-processing unit 4 and the junction unit 5 are installed, a sheet after image formation passes through this junction unit 5 regardless of whether or not any post processing is applied to the sheet.

The junction unit 5 has a first side surface 5F and a second side surface 5B (side surface opposite to the first side surface) parallel to each other in a sheet conveying direction and facing each other. With the junction unit 5 assembled in the internal discharge portion 24, the first side surface 5F is located near the opening of the internal discharge portion 24 toward the front surface 20F of the apparatus main body 2. On the other hand, the second side surface 5B is located at the back of the internal discharge portion 24, i.e. at the side of the rear surface 20B of the apparatus main body 2.

As shown in FIG. 5, the lower and upper guide members 51, 52 are rotatably coupled by hinge portions S at the side of the second side surface 5B. Accordingly, as shown in FIGS. 4 and 5, the upper guide member 52 is rotatable about a side of a rear end portion 522 thereof relative to the lower guide member 51. The junction conveyance path 50 is opened to the outside by a side of the first side surface 5F of the upper guide member 52 being lifted up. However, with the junction unit 5 assembled in the internal discharge portion 24, the upper surface of the upper guide member 52 interferes with the ceiling surface 242 of the internal space when the upper guide member 52 is opened upward to a certain extent. Thus, upward opening of the upper guide member 52 is permitted in an angular range until it comes to interfere with the ceiling surface 242, and the junction conveyance path 50 is opened to the outside to such an extent.

The lower guide member 51 includes a base portion 510 in the form of a flat plate and a plurality of ribs 511 standing up from the base portion 510. Similarly, the upper guide member 52 includes a base portion 520 in the form of a flat plate and a plurality of ribs 521 extending downward from the base portion 520. The lower and upper guide surfaces 51G, 52G shown in FIG. 2 are respectively formed by projecting ends of the ribs 511, 521.

With reference to FIGS. 5 and 6, the base portion 510 of the lower guide member 51 has a holding member 58 mounted at an end edge at the side of the second side surface 5B. The holding member 58 is a rectangular plate member long in the lateral direction, and a bottom end part 581 thereof is mounted on the base portion 510 while an upper end part 582 thereof projects upward from the lower guide surface 51G.

Figure 7:
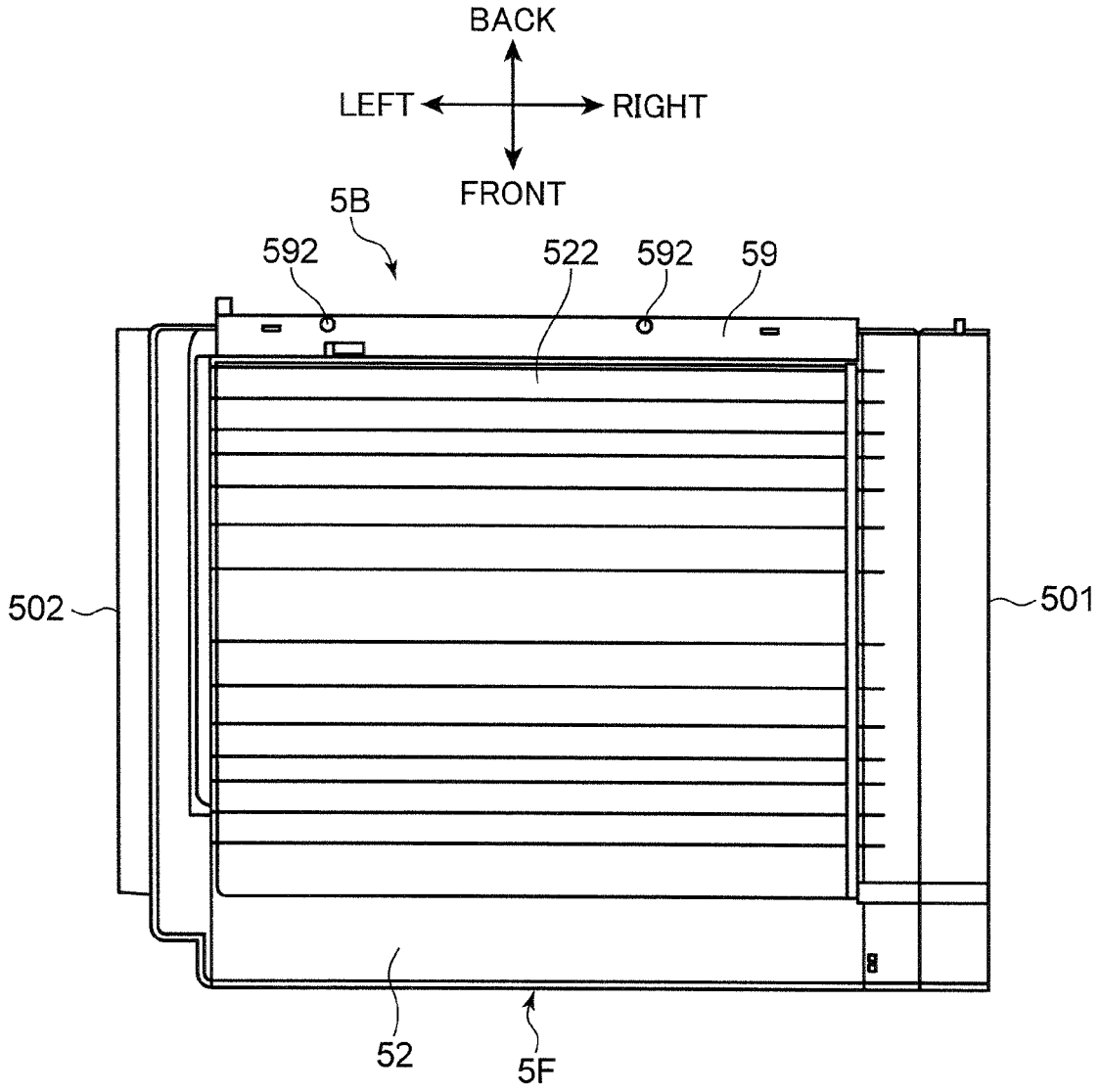
FIG. 7 is a top view of the junction unit.
Figure 8:
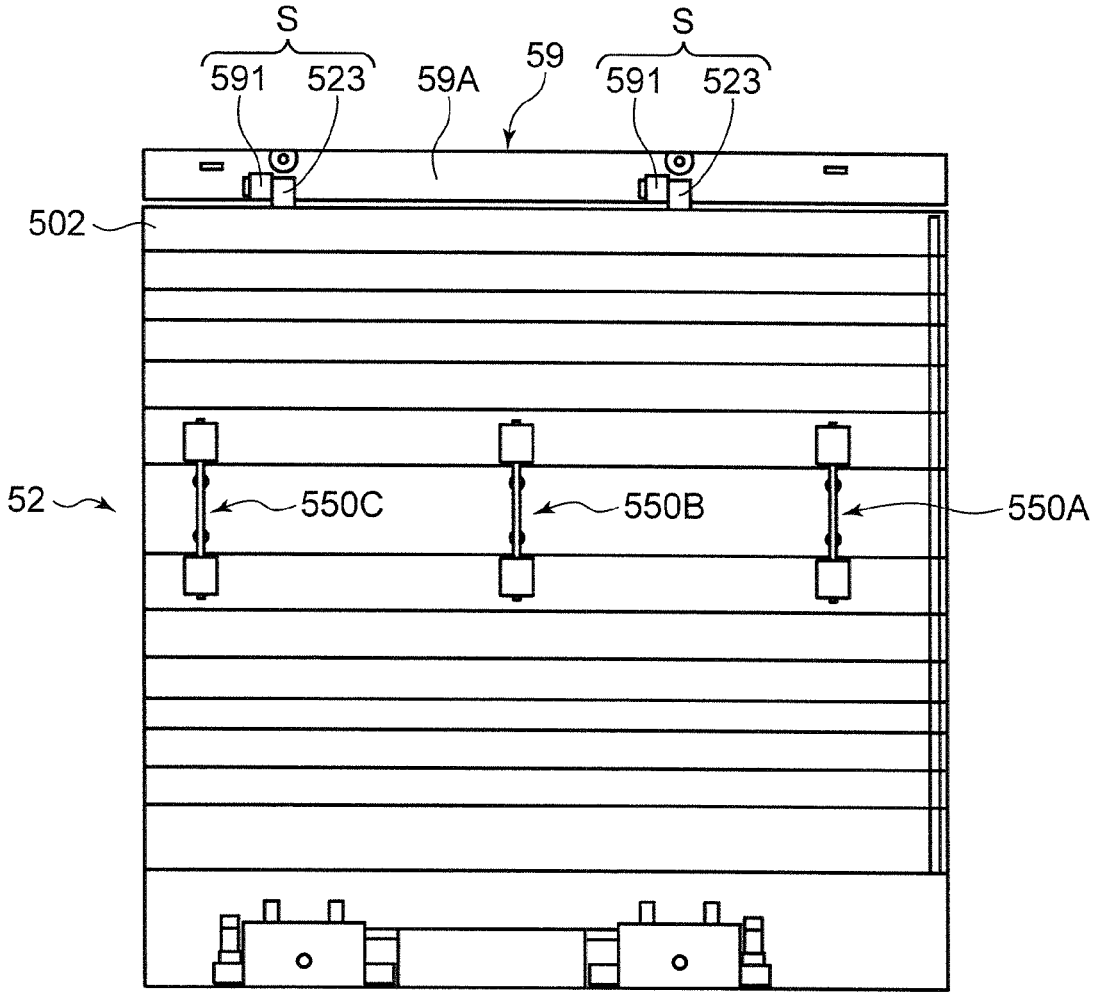
FIG. 8 is a plan view of the upper guide member and a supporting member when viewed from the underside.

A supporting member 59 for rotatably supporting the upper guide member 52 is held on the upper end part 582 of the holding member 58. FIG. 7 is a top view of the junction unit 5 and FIG. 8 is a plan view of the upper guide member 52 and the supporting member 59 detached from the junction unit 5 when viewed from underside. As shown in FIGS. 7 and 8, the supporting member 59 is a plate member long in the lateral direction, and fixed to the holding member 58 by screws 592 (FIG. 7) at two positions of a rear end part thereof.

A front end part of the supporting member 59 projects forward from the holding member 58 so as to face the lower guide surface 51G. The lower surface of a forward projecting part of the supporting member 59 is a facing surface 59A facing the lower guide surface 51G. The hinge portions S are provided on this facing surface 59A. Each hinge portion S is formed by a rotary shaft 523 projecting backward from the side of the second side surface 5B of the upper guide member 52 and a bearing portion 591 (supporting portion) projecting downward from the facing surface 59A of the supporting member 59 for receiving the rotary shaft 523.

Figure 9:
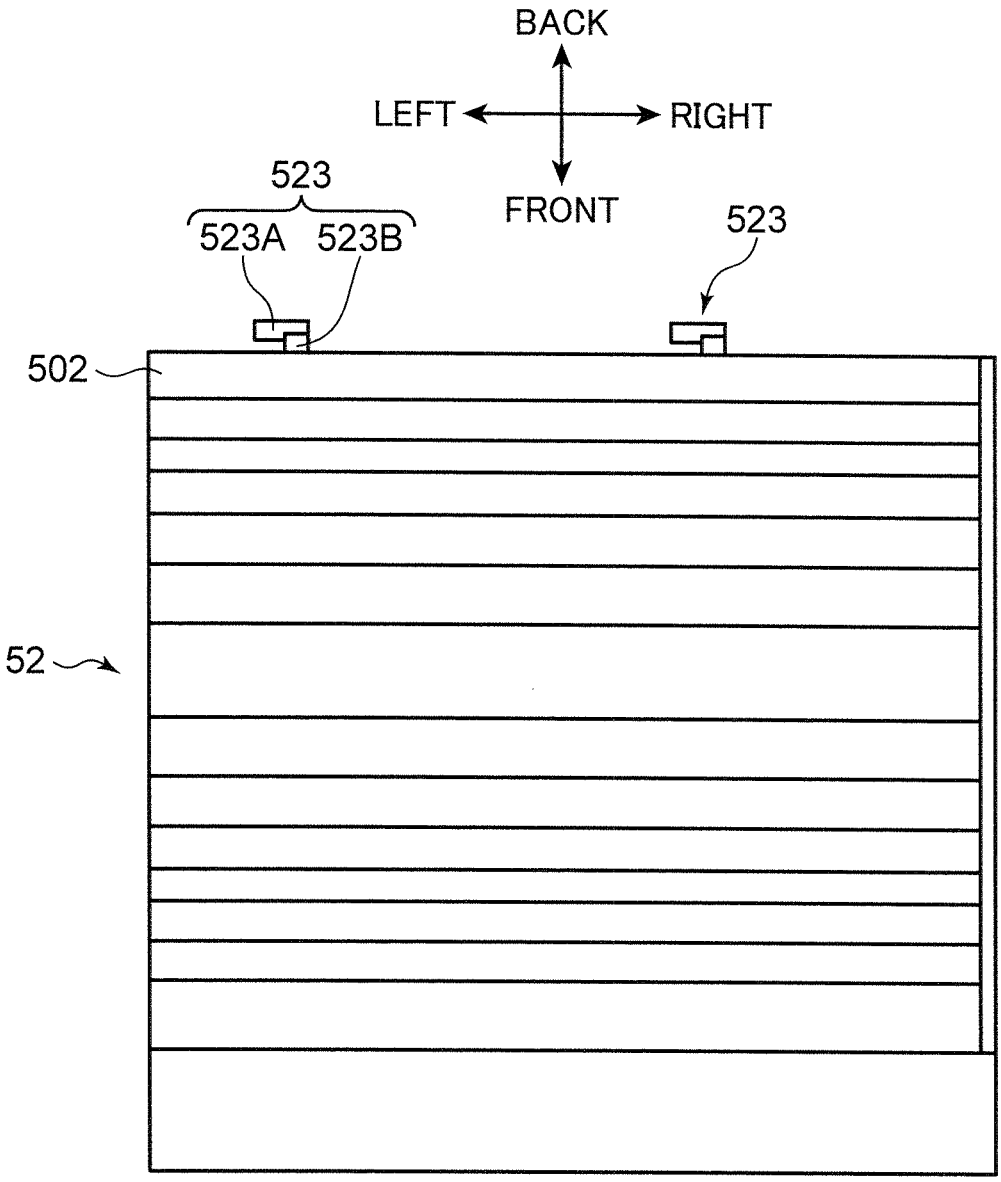
FIG. 9 is a top view of the upper guide member.

FIG. 9 is a top view of only the upper guide member 52. The rotary shaft 523 is integrally formed at the rear end portion 522 of the upper guide member 52. The rotary shaft 523 includes a cylindrical shaft main body 523A extending in the lateral direction and a base end portion 523B extending backward from an end edge of the rear end portion 522 and connected to the right end of the shaft main body 523A. As a result of including such shaft main body 523A and base end portion 523B, the rotary shaft 523 is L-shaped in top view.

The bearing portion 591 (see FIG. 8) includes a tubular space for housing the shaft main bodies 523A of the rotary shafts 523. The upper guide member 52 is mounted on the supporting member 59 by positioning the shaft main bodies 523A and the bearing portions 591 and sliding the upper guide member 52 in the lateral direction. When the supporting member 59 is mounted on the upper guide member 52, the upper guide member 52 is rotatable about the shaft main bodies 523A supported on the bearing portion 591.

Such hinge portions S (bearing portion 591) are arranged in a maximum sheet conveyance area 50A as an area where maximum size sheets (e.g. A3 sheets) out of sheets conveyed by the junction unit 5 (junction conveyance path 50) pass as shown in FIGS. 5 and 6. Specifically, the hinge portions S are provided at positions corresponding to a rear end portion of the maximum sheet conveyance area 50A and higher than the lower guide surface 51G formed by the projecting ends of the ribs 511.

By providing the hinge portions S on the facing surface 59A facing the lower guide surface 51G as in this embodiment, a supporting point of rotation of the upper guide member 52 does not project backward from the second side surface 5B of the junction unit 5. Thus, the junction unit 5 can be miniaturized. Particularly, the hinge portions S are arranged at positions located in the maximum sheet conveyance area 50A and a useless space used only for setting the hinge portions S is omitted to ensure a maximum area for sheet conveyance, wherefore the junction unit 5 is further miniaturized.

On the other hand, the hinge portions S are set at positions higher than the lower guide surface 51G and the upper guide surface 52G facing the lower guide surface 51G by the holding member 58 standing up from the base portion 510 of the lower guide member 51. Thus, even if the hinge portions S are arranged in the maximum sheet conveyance area 50A, a sheet being conveyed in the junction conveyance path 50 between the lower guide surface 51G and the upper guide surface 52G does not interfere with the hinge portions S, wherefore a sheet conveying property is not impaired.

As shown in FIG. 6, a front edge portion 593 of the supporting member 59 serves as a contact portion with a rear edge 524 of the upper guide member 52. In other words, when the upper guide member 52 is rotated upward about shafts of the bearing portions 591 by a predetermined angle, the rear edge 524 comes into contact with the front edge portion 593, thereby preventing the upper guide member 52 from being opened any further.

In the junction unit 5 thus constructed, a part of the lower guide surface 51G of the lower guide member 51 is recessed downward to form a recessed portion 53 in this embodiment (see FIGS. 3 and 4). This recessed portion 53 includes an end edge portion at the first side surface 5F and extends in a direction toward the second side surface 5B (direction toward the back side of the internal space). The recessed portion 53 is a moderately arcuate recess provided near the center of the first side surface 5F in the sheet conveying direction, and the lateral width and largest vertical depth thereof are so sized that the user can insert his hand with the upper guide member 52 closed.

By providing the junction unit 5 with the recessed portion 53, a sheet jam in the junction unit 5 can be better dealt with. As described above, an opening angle of the upper guide member 52 is restricted and even if the upper guide member 52 should be opened in the case of a sheet jam in the junction conveyance path 50, it is difficult to take the jammed sheet out from the junction conveyance path 50. However, by providing the lower guide member 51 with the recessed portion 53, a space for the user to insert his or her hand toward the junction conveyance path 50 is ensured. In an actual jam process, the user inserts his or her hand through the recessed portion 53 to give an opening force to the upper guide member 52 and removes a jammed sheet while opening the junction conveyance path 50.

The recessed portion 53 is formed by an arcuate concave surface 531 arcuately recessing a part of the base portion 510 and cutout portions of left ribs 512L and right ribs 512R adjacent to and downstream and upstream of the arcuate concave surface 531 in the conveying direction and present at positions near the first side surface 5F. The cutout portions of these ribs 512L, 512R are arcuate cutouts in conformity with arcuate curves of the arcuate concave surface 531. Note that the heights of the left and right ribs 512L, 512R where no cutouts are formed are the same as that of a center rib standing near the center of the lower guide member 51. Since the recessed portion 53 is formed to be an arcuate moderate curve along the sheet conveying direction in this way, particularly since a downstream end portion thereof in the sheet conveying direction is inclined upward toward the leading end, it can be made difficult for a sheet being conveyed to be caught by the recessed portion 53.

Figure 10:
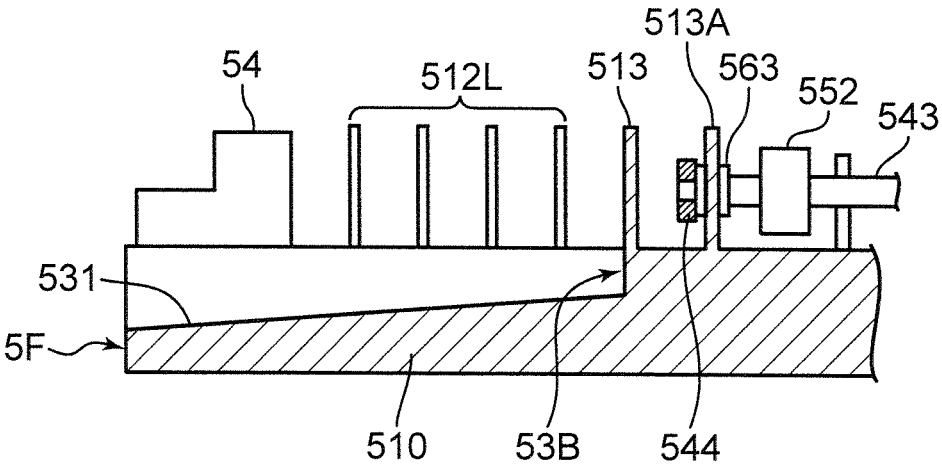
FIG. 10 is a sectional view along X-X of FIG. 4.

FIG. 10 is a sectional view along X-X of FIG. 4. The arcuate concave surface 531 is inclined downward toward the first side surface 5F (front surface) from the back side as shown in FIG. 10. In other words, a cross-sectional area of the recessed portion 53 is set to be largest at the first side surface 5F. This makes it easier for the user to insert his or her hand. Of course, the arcuate concave surface 531 may include no such inclined portion.

Figure 11:
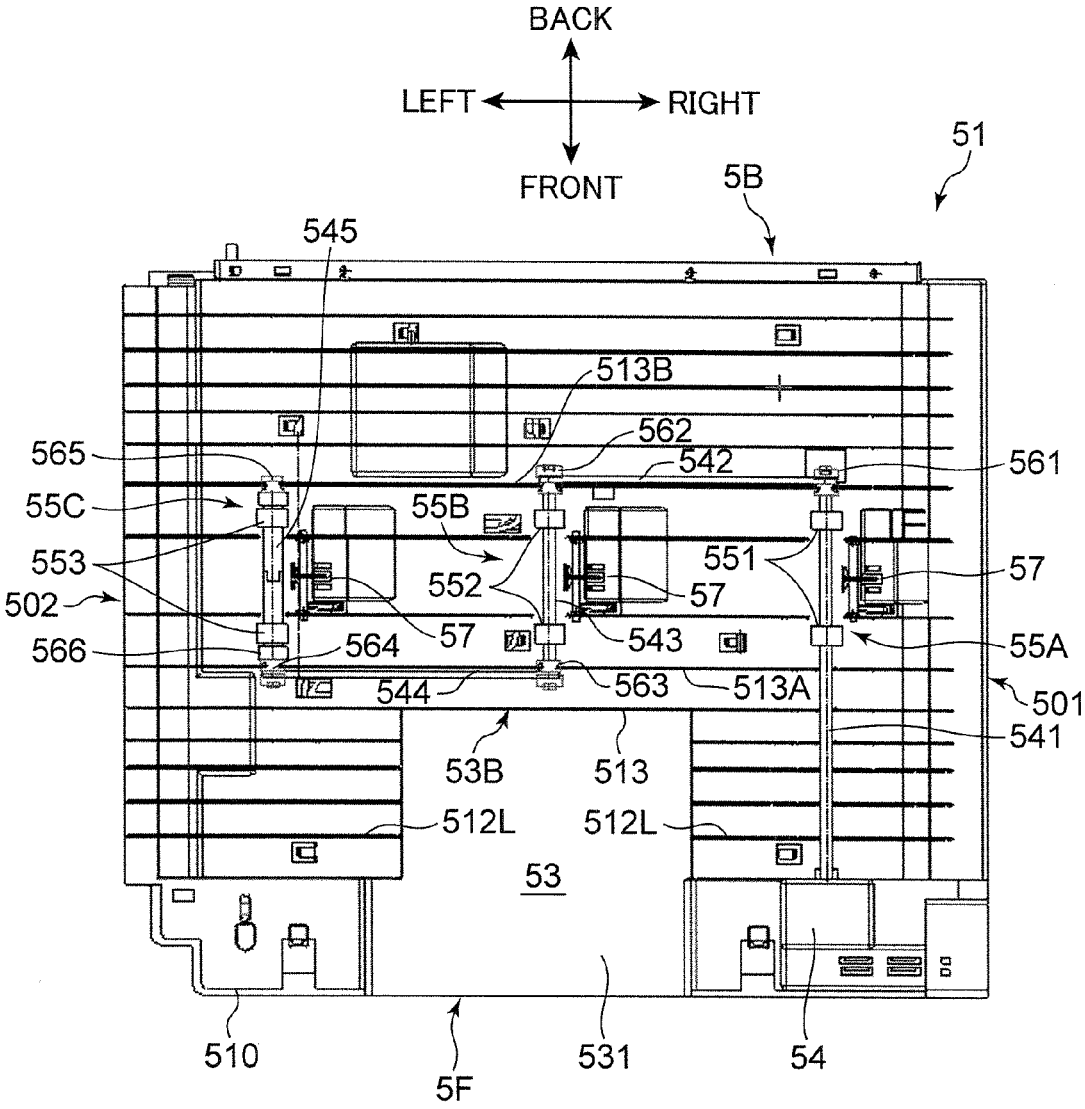
FIG. 11 is a top view of a lower guide member.

The recessed portion 53 has such a length from the first side surface 5F toward the second side surface 5B as to reach an inner side of the above maximum sheet conveyance area 50A. FIG. 11 is a top view of the lower guide member 51, and FIG. 12 is a top view of the lower guide member 51 marked with the maximum sheet conveyance area 50A and a conveying force application area 50B for applying a conveying sheet to a sheet being conveyed by the junction unit 5.

Figure 12:
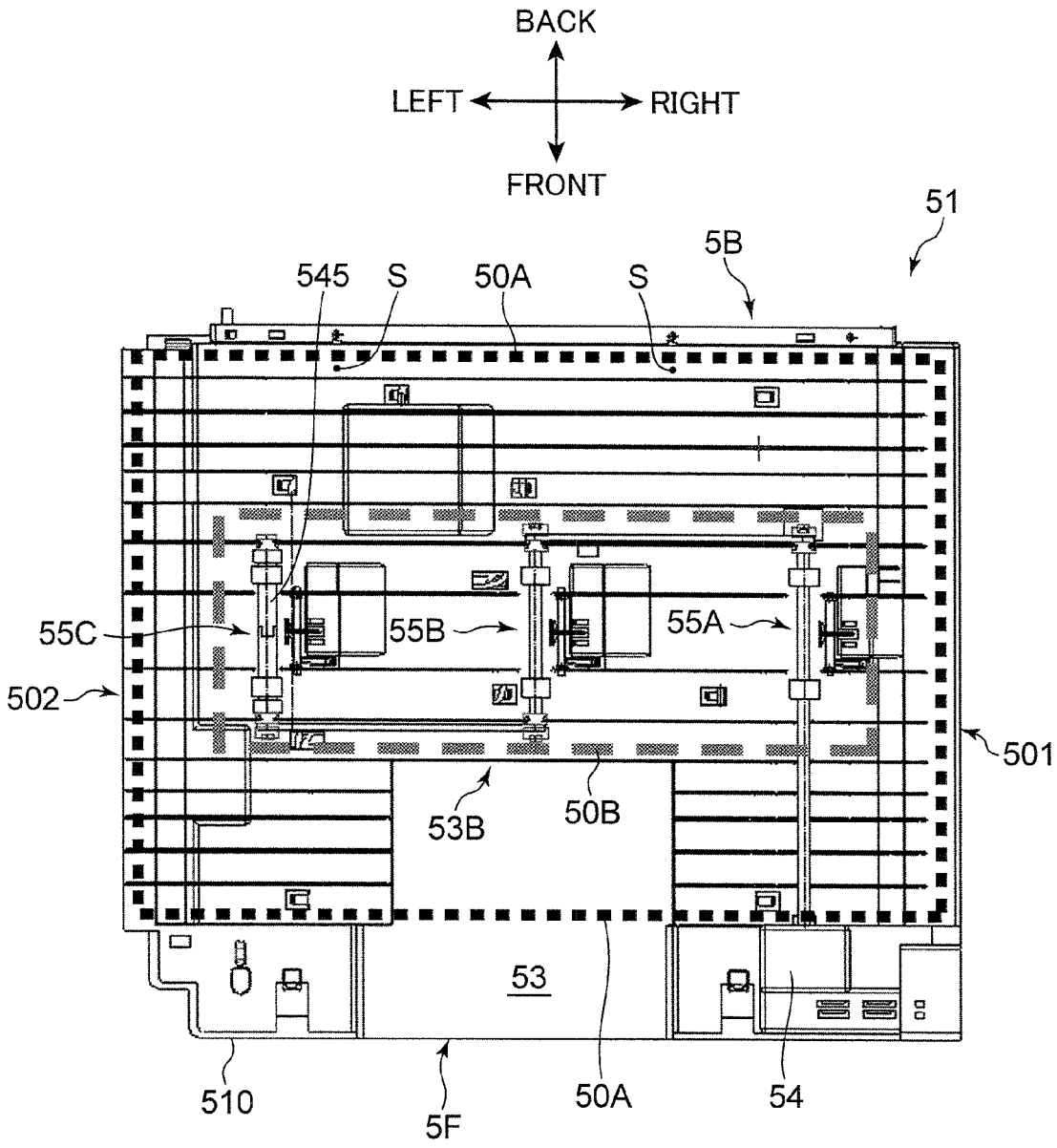
FIG. 12 is a top view of the lower guide member marked with a sheet conveyance area and a conveying force application area.

The maximum sheet conveyance area 50A shown in FIG. 12 is an area where, for example, sheets of A3 size pass, and a sheet carried in through the carry-in opening 501 is conveyed from right to left and carried out through the carry-out opening 502. A sheet of a smaller size than the A3 size is conveyed near the center in the maximum sheet conveyance area 50A. FIG. 12 diagrammatically shows the positions of the above hinge portions S.

The conveying force application area 50B is arranged near the center of the junction unit 5 in forward and backward directions, and three first, second and third conveyor rollers 55A, 55B and 55C are arranged at regular intervals in the lateral direction. These conveyor rollers 55A, 55B and 55C have a rotational force applied thereto from a motor 54 mounted in the lower guide member 51, and a sheet is conveyed by this rotational force. Note that driven rollers 550A, 550B and 550C (see FIG. 8) which form conveyance nips together with the conveyor rollers 55A, 55B and 55C are mounted on the upper guide member 52 at positions facing the corresponding conveyor rollers 55A, 55B and 55C.

The recessed portion 53 extends from the first side surface 5F as an opening end edge up to the inner side of the maximum sheet conveyance area 50A described above, and an end portion 53B at the back side thereof is set before the conveying force application area 50B. A rib 513 at the back (rear) side of this end portion 53B is a normal rib formed with no recessed part. Since the recessed portion 53 has such a length in the direction toward the back side, the user can easily insert his or her hand to the maximum sheet conveyance area 50A through the recessed portion 53 and a jam processing property can be further improved. If a sheet of a smallest size (e.g. sheet of a postcard size) of those conveyed by the junction unit 5 is jammed, the user can easily deal with a jam through the recessed portion 53 since the end portion 53B of the recessed portion 53 is set before the conveying force application area 50B.

Here, mainly with reference to FIG. 11, a sheet conveying mechanism of the junction unit 5 is described. The motor 54 as a drive source is mounted at a position near the first side surface 5F of the lower guide member 51 and upstream of three recessed portion 53 in the conveying direction. The drive of the motor 54 is controlled by a controller (not shown) provided in the apparatus main body 2. One end of a first roller shaft 541 of the first sheet conveyor roller 55A is directly coupled to an output shaft of the motor 54, and the other end thereof is supported by a bearing 561 mounted on a last rib 513B of the conveying force application area 50B. Two roller members 551 which rotate together with the roller shaft 541 are fixed to the first roller shaft 541.

A second roller shaft 543 of the second sheet conveyor roller 55B is arranged substantially at a lateral center position of the lower guide member 51, and the opposite ends thereof are supported by bearings 563, 562 respectively mounted on ribs 513A, 513B. Two roller members 552 which rotate together with the roller shaft 543 are fixed to the second roller shaft 543. A rotational drive force is transmitted from the first roller shaft 541 to the second roller shaft 543 via a first endless belt 542. The first endless belt 542 is mounted between the bearings 561 and 562.

A third roller shaft 545 of the third sheet conveyor roller 55C is arranged at a position near the left end of the lower guide member 51, and the opposite ends thereof are supported by bearings 564, 565 respectively mounted on the ribs 513A, 513B. Two roller members 553 which rotate together with the roller shaft 545 are fixed to the third roller shaft 545, and a one-way clutch 566 is mounted on this roller shaft 545. A rotational drive force is transmitted from the second roller shaft 543 to the third roller shaft 545 via a second endless belt 544. The second endless belt 544 is mounted between the bearings 563 and 564.

The one-way clutch 566 is provided to allow the third sheet conveyor roller 55C to idly rotate when a large rotational load acts on the third sheet conveyor roller 55C mounted on the third roller shaft 545, e.g. when a strong pulling force acts on a sheet with the sheet nipped by the third sheet conveyor roller 55C. Thus, the third sheet conveyor roller 55C can be separated from a driving system and idly rotated when a sheet is pulled from the junction unit 5 to the post-processing unit 4 at a high speed, wherefore a conveyance load can be reduced.

Sheet detecting sensors 57 are arranged in proximity to the corresponding first, second and third sheet conveyor rollers 55A, 55B and 55C. The sheet detecting sensors 57 are photointerrupters and detect the jamming of a sheet in the junction unit 5.

Here, the driving system for the first, second and third sheet conveyor rollers 55A, 55B and 55C is so arranged as to be housed between the ribs 513, 513A and 513B while avoiding the formation position of the recessed portion 53. With reference to FIG. 10, for example, the second endless belt 544 is housed between the rib 513 defining the end portion 53B of the recessed portion 53 and the rib 513A immediately behind the rib 513 and supporting the bearing 563. Thus, even if the recessed portion 53 expected to have a user's hand inserted thereinto is formed in the lower guide member 51, it can be hindered that the user's hand reaches the rollers and the driving system (particularly the second endless belt 544, roller member 552 and second roller shaft 543), thereby preventing unintended damages from being given to these.

According to the image forming apparatus 1 of this embodiment described above, a user can easily remove a sheet by inserting his or her hand into the recessed portion 53 of the lower guide member 51 and opening the upper guide member 52 at the time of a jam process by mounting the upper guide member 52 rotatable with respect to the lower guide member 51. Since the supporting point of rotation (hinge portions S) of the upper guide member 52 is arranged in the maximum sheet conveyance area 50A, it does not project backward from the junction unit 5 and the junction unit 5 can be miniaturized. Further, since the hinge portions S are set at such height positions by the holding member 58 as not to interfere with the junction conveyance path 50, they do not affect sheet conveyance. Accordingly, it is possible to provide a junction unit which can be easily assembled even into a small-size image forming apparatus with a relatively small internal discharge space and an image forming apparatus employing such a junction unit.

The present invention is not limited to the construction of the image forming apparatus 1 (junction unit 5) described above, and may be, for example, embodied as follows.

(1) In the above embodiment, the first guide member is the lower guide member 51 and the second guide member is the upper guide member 52 since the junction unit 5 conveys a sheet in the horizontal direction across the internal discharge portion 24. The conveyance path by the junction unit 5 may not extend in the horizontal direction and may be a vertical conveyance path, an inclined conveyance path inclined downward or upward toward its leading end, or a curved conveyance path.

(2) In the above embodiment, the recessed portion 53 is provided in the lower guide member 51 to enable a user to insert his or her hand from the side of the first side surface 5F of the junction unit 5. Instead, a recessed portion similar to the recessed portion 53 of the above embodiment may be provided in the upper guide member 52 at the side of the first side surface 5F. Alternatively, recessed portions may be provided in both the lower guide member 51 and the upper guide member 52. Alternatively, the recessed portion 53 may be omitted.

(3) In the above embodiment, the hinge portions S are shown as an example of the rotatable supporting portion. This is only an example and another rotating mechanism may be employed as long as this mechanism enables the upper guide member 52 to be rotated and opened with respect to the lower guide member 51.

The specific embodiment described above mainly includes inventions having the following constructions.

According to one aspect of the present invention, an image forming apparatus includes an apparatus main body for performing an image forming process on a sheet; an internal discharge portion formed in the apparatus main body as an internal space with an opening exposed to the outside and capable of storing a sheet after the image forming process; a discharge opening provided in the apparatus main body to face the internal space and adapted to discharge a sheet to the internal discharge portion; a post-processing unit to be attached later to the apparatus main body, including a receiving opening for sheets and adapted to apply a specified post processing to a received sheet; and a junction unit to be assembled into the internal discharge portion and adapted to convey a sheet from the discharge opening to the receiving opening, wherein the junction unit includes a first guide member having a first guide surface for guiding a sheet, a second guide member having a second guide surface facing the first guide member at a predetermined distance therefrom and a supporting member for supporting the second guide member by a rotatable supporting portion; and the supporting member has a facing surface facing the first guide surface and has the supporting portion arranged on the facing surface.

A junction unit according to another aspect of the present invention includes a first opening for receiving a sheet; a second opening for feeding out the sheet; a lower guide member forming a lower guide surface of a conveyance path for conveying the sheet from the first opening and the second opening substantially in a horizontal direction; an upper guide member forming an upper guide surface of the conveyance path and rotatably mounted on the lower guide member; and a supporting member for supporting the upper guide member by a rotatable supporting portion, wherein the supporting member has a facing surface facing the lower guide surface and the supporting portion is arranged on the facing surface.

According to these constructions, since the rotatable supporting portion for rotating the second guide member (upper guide member) is arranged on the facing surface facing the first guide surface (lower guide surface), there is no likelihood that the supporting portion is formed in such a manner as to project from the junction unit. Thus, the junction unit can be miniaturized and, consequently, the internal discharge portion and the image forming apparatus can also be miniaturized.

In the above construction, the supporting portion is preferably arranged in a maximum sheet conveyance area where sheets of a maximum size out of sheets to be conveyed in a sheet conveyance path formed by the first and second guide surfaces pass.

According to this construction, the junction unit can be further miniaturized since the supporting portion is arranged at a position in the maximum sheet conveyance area.

In the above construction, it is preferable that the junction unit is for conveying a sheet substantially in a horizontal direction; that the first guide member is a lower guide member whose guide surface forms a lower guide surface of a conveyance path for the sheet, that the second guide member is an upper guide member whose guide surface forms an upper guide surface of the conveyance path for the sheet; that the lower and upper guide members have first side surfaces located near the opening of the internal space with the junction unit assembled in the internal discharge portion; that the supporting member is arranged at a side of second side surfaces opposite to the first side surfaces; and that the upper guide member is openable upward in a range up to a limit where the upper guide member interferes with a ceiling surface of the internal space.

This construction can cope with a general-purpose image forming apparatus of an internal discharge type in which a post-processing unit is installed on a side wall opposite to a side wall where a sheet discharge opening of an apparatus main body is provided and a sheet is conveyed from the sheet discharge opening to the post-processing unit by a junction unit. A user can open the upper guide member at the side of the first side surface and perform a jam processing.

In this case, the supporting member is preferably held by a holding member standing upward from the second side surface of the lower guide member.

According to this construction, a structure advantageous in reduction in the number of parts and structural simplification can be realized since the supporting member extends from the side of the second side surface of the lower guide member.

In the above construction, it is preferable that a rotary shaft is integrally formed to project from the second side surface of the upper guide member; and that the supporting portion is a bearing formed on the facing surface for receiving the rotary shaft.

According to this construction, the construction of a supporting part can be simplified and, particularly, the upper guide member fitted with the rotary shaft can be easily formed by die molding or the like, which is also advantageous in terms of cost.

According to the present invention described above, the junction unit to be assembled later into an internal discharge space can be miniaturized. Thus, it is possible to provide a junction unit to be easily assembled even into an image forming apparatus with a relatively small internal discharge space and an image forming apparatus employing such a junction unit.

This application is based on Japanese Patent application No. 2010-064327 filed in Japan Patent Office on Mar. 19, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an apparatus main body for performing an image forming process on a sheet;

an internal discharge portion formed in the apparatus main body as an internal space with an opening exposed to the outside and capable of storing a sheet after the image forming process;

a discharge opening provided in the apparatus main body to face the internal space and adapted to discharge a sheet to the internal discharge portion;

a post-processing unit to be attached later to the apparatus main body, including a receiving opening for sheets and adapted to apply a specified post processing to a received sheet; and a junction unit to be assembled into the internal discharge portion and adapted to convey a sheet from the discharge opening to the receiving opening; wherein:

the junction unit includes a first guide member having a first guide surface for guiding a sheet, a second guide member having a second guide surface facing the first guide member at a predetermined distance therefrom, and a supporting member for supporting the second guide member by a rotatable supporting portion and a holding member provided on the first guide member for holding the supporting member;

the supporting member has a facing surface facing the first guide surface and has the rotatable supporting portion arranged on the facing surface; and the rotatable supporting portion is arranged in a maximum sheet conveyance area where sheets of a maximum size out of sheets to be conveyed in a sheet conveyance path formed by the first and second guide surfaces pass, the supporting portion lying entirely in the maximum sheet conveyance area in both a sheet conveyance direction and in a width direction perpendicular to the sheet conveyance direction.

2. An image forming apparatus according to claim 1, wherein:

the supporting member is arranged near a side end portion of the maximum sheet conveyance area.

3. An image forming apparatus according to claim 1, wherein:

the junction unit is for conveying a sheet substantially in a horizontal direction;

the first guide member is a lower guide member whose guide surface forms a lower guide surface of a conveyance path for the sheet;

the second guide member is an upper guide member whose guide surface forms an upper guide surface of the conveyance path for the sheet;

the lower and upper guide members have first side surfaces located near the opening of the internal space with the junction unit assembled in the internal discharge portion;

the supporting member is arranged at a side of second side surfaces opposite to the first side surfaces; and the upper guide member is openable upward in a range up to a limit where the upper guide member interferes with a ceiling surface of the internal space.

4. An image forming apparatus according to claim 3, wherein:

the rotatable supporting portion is arranged in the maximum sheet conveyance area and near a side end portion of the maximum sheet conveyance area at the side of the second side surfaces.

5. An image forming apparatus according to claim 3, wherein:

the holding member stands up from the second side surface of the lower guide member.

6. An image forming apparatus according to claim 4, wherein:

the holding member stands up from the second side surface of the lower guide member; and the rotatable supporting portion is provided at a position higher than the lower guide surface.

7. An image forming apparatus according to claim 6, wherein:

the lower guide member includes a base portion in the form of a flat plate and a plurality of ribs standing upward from the base portion; and the holding member is mounted on an end edge of the base portion at the side of the second side surfaces and an upper end part thereof projects upward from the lower guide surface.

8. An image forming apparatus according to claim 3, wherein:

a rotary shaft is integrally formed to project from the second side surface of the upper guide member; and the rotatable supporting portion is a bearing formed on the facing surface for receiving the rotary shaft.

9. An image forming apparatus according to claim 3, wherein:

the lower guide member includes a recessed portion formed by downwardly recessing a part of the lower guide surface.

10. A junction unit, comprising:

a first opening for receiving a sheet;

a second opening for feeding out the sheet;

a lower guide member forming a lower guide surface of a conveyance path for conveying the sheet from the first opening and the second opening substantially in a horizontal direction;

an upper guide member forming an upper guide surface of the conveyance path and rotatably mounted on the lower guide member;

a supporting member for supporting the upper guide member by a rotatable supporting portion; and a holding member provided on the lower guide member for holding the supporting member; wherein:

the supporting member has a facing surface facing the lower guide surface and the rotatable supporting portion is arranged on the facing surface, and the rotatable supporting portion is arranged in a maximum sheet conveyance area where sheets of a maximum size out of sheets to be conveyed in the sheet conveyance path formed by the lower and upper guide surfaces pass, the supporting portion lying entirely in the maximum sheet conveyance area in both a sheet conveyance direction and in a width direction perpendicular to the sheet conveyance direction.

11. A junction unit according to claim 10, wherein:

the supporting member is arranged near a side end portion of the maximum sheet conveyance area.

12. A junction unit according to claim 10, wherein:

the lower and upper guide members have first side surfaces and second side surfaces opposite to the first side surfaces;

the supporting member is arranged at the side of the second side surfaces; and the rotatable supporting portion is arranged in the maximum sheet conveyance area and near a side end portion of the maximum sheet conveyance area at the side of the second side surfaces.

13. A junction unit according to claim 10, wherein:

the lower and upper guide members have first side surfaces and second side surfaces opposite to the first side surfaces;

the holding member stands up from the second side surface of the lower guide member; and the rotatable supporting portion is provided at a position higher than the lower guide surface.

* * * * *